United States Patent [19]

Harzenmoser

[11] 4,353,467

[45] Oct. 12, 1982

[54] SORTING OF SPINNING BODIES

[75] Inventor: Isidor Harzenmoser, Wallisellen, Switzerland

[73] Assignee: Zellweger Uster A.G., Uster, Switzerland

[21] Appl. No.: 189,706

[22] Filed: Sep. 22, 1980

[30] Foreign Application Priority Data

Oct. 29, 1979 [CH] Switzerland ..... 9659/79

[51] Int. Cl.[3] ..... B65G 47/24; B07C 5/00

[52] U.S. Cl. ..... 209/559; 209/927; 209/657

[58] Field of Search ..... 209/927, 657, 559, 564, 209/566, 933, 552

[56] References Cited

U.S. PATENT DOCUMENTS

| | | | |
|---|---|---|---|
| 3,195,298 | 7/1965 | Furst | 209/927 X |
| 3,230,305 | 1/1966 | Kendrick | 209/927 X |
| 3,405,877 | 10/1968 | Jenny | 209/927 X |
| 3,934,716 | 1/1976 | Heckel | 209/927 X |

FOREIGN PATENT DOCUMENTS

| | | | |
|---|---|---|---|
| 957162 | 5/1964 | United Kingdom | 209/927 |

*Primary Examiner*—Allen N. Knowles

*Attorney, Agent, or Firm*—Antonelli, Terry & Wands

[57] ABSTRACT

A spinning machine has a plurality of spinning stations and a transport installation including a conveyor belt for receiving ready spun spinning bodies and for conveying them to a container in a predetermined sequence. A thread sensor scans the spinning stations with respect to thread breaks and supplies corresponding data to an evaluation device. This device has a memory in which the thread break number and thread break standstill time of the individual spinning bodies are stored and expressed on call. These stored values are used to control a sorting device which operates in such a way that the spinning bodies are sorted into different containers according to their thread break number and thread break standstill time. A quality selection of the spinning bodies may, therefore, be made in that, for example, all spinning bodies which are produced without any thread breaks and with the same yarn length are judged as being perfect and may be directly further used.

14 Claims, 6 Drawing Figures

SORTING OF SPINNING BODIES

BACKGROUND OF THE INVENTION

The present invention relates to the sorting of spinning bodies with respect to their thread break number and/or with respect to the length of the spinning product wound thereon. The term "spinning bodies" as used herein refers to bobbins formed on ring spinning machines as well as cross-wound bobbins produced on open end machines.

The progressive automation of the working steps in the textile spinning process has lead to the fact that the ejection of the finished spinning bodies and the creeling of the empty tubes is also effected automatically. The full spinning bodies are removed from the spinning stations and are transferred to a conveyor belt of a transport installation. A transport installation of this type for ring spinning machines is described, for example, in the doffer installation of Swiss Pat. No. 556,404. In this installation, the spinning bodies are deposited in exactly the same sequence as they were arranged on the spinning rail. When the spinning bodies have been deposited on the conveyor belt, the belt is activated and the spinning bodies fall into a container. Quality-conscious spinning factories require the spinning operators to eliminate spinning bodies which have thread breaks, since it is known that these spinning bodies produce difficulties in further processing in subsequent production steps.

Moreover, spinning machines are provided with thread break detectors. For example, in the case of ring spinning, this detector comprises a sensor which scans the spinning stations or, in the case of open-end spinning, comprises an electro-mechanical thread sensor which is installed at each spinning station and which reports to a central evaluation device when there is a thread break at a spinning station. The relevant spinning stations are identified in the evaluation device and the position of the spinning bodies and the thread break numbers associated therewith and thread break durations (standstill times) are stored in the form of data. The thread break number is a measurement for the yarn quality and the thread break duration is a measurement for the yarn length of the correspondingly-produced spinning body.

BRIEF DESCRIPTION OF THE INVENTION

An object of this invention is to use this stored data for sorting the spinning bodies when they are deposited by the transport installation, according to the number of thread breaks contained in each spinning body or according to the total of the standstill times established for each spinning body or a combination thereof. This sorting procedure consists in allocating the spinning bodies into at least two classes or categories. If the thread break number contained in a spinning body is evaluated, then this is a measurement for the quality of the spinning product. The classes may therefore be chosen in such a way that a first product class or category having a tolerable thread break number and at least one other product class or category having a higher thread break number are determined.

However, the total of the standstill times may be assessed as a measurement for the length of the spinning product contained on the spinning body. A spinning body which had no standstill time whatsoever during its build up contains the maximum possible length, while all other spinning bodies contain shorter lengths according to the standstill times occurring during their build up. It is, therefore, a prerequisitie that all spinning bodies are creeled simultaneously and are also doffed simultaneously. Therefore, one class or category with an optimum length of the spinning product and at least one other class or category with a shorter length may be produced.

Therefore, according to the invention there is provided a method of sorting spinning bodies on spinning machines provided with thread break detectors and relevant memories for establishing the number of thread breaks and/or the duration of the standstills of the spinning bodies as well a with transport installations for further conveying the spinning bodies, wherein a sorting device is associated with the transport installation, and is, during the serial ejection of the spinning bodies controlled in accordance with stored values for the thread break numbers and/or for the standstill times.

The invention also provides an apparatus for carrying out this method comprising a sorting device arranged at a serial ejection point for the spinning bodies from a transport installation, an evaluation device having a memory in which values determined by the thread break number and/or standstill time corresponding to the position of the spinning bodies in the spinning machine can be stored, and means responsive to the said values to control the sorting device.

The sorting step of the full bobbin bodies which is possible by the invention, provides the spinning operator with a number of advantages. For example, he can list all spinning bodies which do not contain a thread break. Therefore, these bodies are perfect in quality and also have the same length of yarn throughout. They may therefore be directly moved on for further processing without an additional checking.

Whether the spinning bodies which are eliminated having one or more thread breaks are all retained for checking or are sub-divided into further classes with a few breaks (for example, up to three) or more thread breaks (for example, four and more) and should optionally be used as poorer quality, is a question of the economy of the spinning factory, but may be realized, as required, using the apparatus according to the invention.

BRIEF DESCRIPTION OF THE DRAWINGS

Some embodiments will now be described with reference to the accompanying drawings in which.

DETAILED DESCRIPTION OF THE PREFERRED EMBODIMENTS

Figure 1:
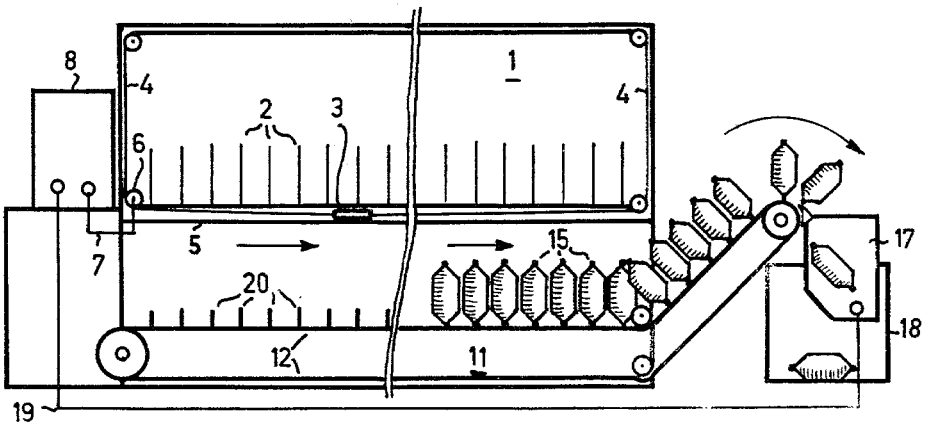
FIG. 1 schematically illustrates the application of the invention to a ring spinning machine, parts of the spinning machine and a spinning body doffing device being illustrated.

FIG. 1 shows only those parts of a spinning machine 1 which are essential for an explanation of the present invention. The machine illustrated is, for example, a ring spinning machine with a plurality of spinning stations 2 at each of which bobbins are completely wound with thread supplied from a drafting system in the well-known manner. Each station has a conventional spinning ring with a traveller for winding the respective bobbins. The spinning machine 1 also has a thread supervision system which includes a thread sensor 3 and an evaluation device 8. The sensor 3 is caused to travel along a rail 5 past the spinning stations 2 by a traction member 4. During this movement, the sensor 3 detects at each spinning station whether the thread at that station is being spun correctly or whether the production of thread has been interrupted because of a thread break. A corresponding electrical signal produced by the sensor 3 is, for example, supplied to a deflection roller 6 designed as a current collector and is fed into the evaluation device 8 through a connection line 7. The thread sensor 3, traction member 4, current collector 6 and means for forming the thread run signal detected by the sensor 3 are described, for example, in Swiss Pat. No. 601,093.

The signals produced by the thread sensor 3 during its forward and return motion are processed in the evaluation device 8 and are stored in a memory therein so that they may be obtained, for example, periodically or on demand at any time. In this processing operation, each spinning station 2 is specified and its behavior is stored with respect to the number and duration of thread breaks.

Recent spinning machines have been equipped with a transport installation 11. The purpose of this installation is to take over the fully wound spinning bobbins 15 from the spinning station 2 and to convey them to a collecting container 18. In a specific embodiment, the spinning bobbins 15, which are all full at the same time, are removed from the spinning stations 2 by an apparatus (not shown) and transferred to a conveyor belt 12. Thus, the spinning bobbins 15 are in exactly the same sequence on the conveyor belt 12 as they were arranged previously on the ring rail of the spinning machine.

When the spinning bobbins 15 have been positioned on the conveyor belt 12, the belt starts to move in the direction of the arrows. The spinning bodies 15 therefore travel along the machine and fall into a container 18 at the end of the machine.

In the apparatus of this invention, a sorting device 17 is positioned between the conveyor belt 12 and the container 18. The container is preferably subdivided into individual chambers, or separate containers may be used with the sorting device 17.

Since the thread break frequency and thread break standstill duration for each spinning bobbin 15 is stored in the evaluation device 8, and since the sequence of the bodies is given, the evaluation device 8 can control the sorting device 17 so that the spinning bobbins 15 with the predetermined thread break frequency and thread break standstill times fall into chambers provided for them in the container 18.

Spinning bobbins 15 which have been spun without a thread break always have a determined uniform thread length, while all spinning bobbins 15 which have one or more thread breaks during their formation contain a shorter yarn length and are correspondingly inferior in quality.

It is, therefore, possible by selecting the spinning bobbins 15 according to their thread break number to combine the perfect spinning bodies in a container when they are being collected and to eliminate the defective spinning bodies.

In a first embodiment of the invention, the spinning bobbins 15 which have been eliminated because they have thread breaks may be further subdivided into classes, whereby, for example, a second range may be chosen with a tolerable thread break number and/or standstill time. The choice of range and a corresponding change of the sorting device 17 is effected in such a way that the stored data in the evaluation device 8 is correspondingly supplied through a control cable 19.

Figure 2:
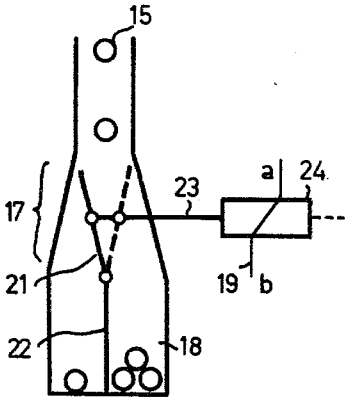
FIG. 2 illustrates a sorting device for two product classes.

FIGS. 2 to 5 illustrate some examples of sorting devices 17. FIG. 2 shows a two-chamber device. The container 18 has a partition wall 22 to which is connected a sorting lever 21. This sorting lever is connected to a push rod 23 which is movable by an electromagnet 24. During a rest condition, when there is no voltage on the control cable 19, the sorting lever 21 is in the position illustrated in full lines so that the spinning bobbins 15 falling into the container 18 are directed into the right-hand chamber in the drawing. If the evaluation device 8 now reports the arrival of a defective spinning body, the electromagnet 24 is energized by a flow of current in the control cable 19 and the push rod 23 swings the sorting lever 21 to the right. Thus, the defective spinning body will fall into the left-hand chamber.

Figure 3:
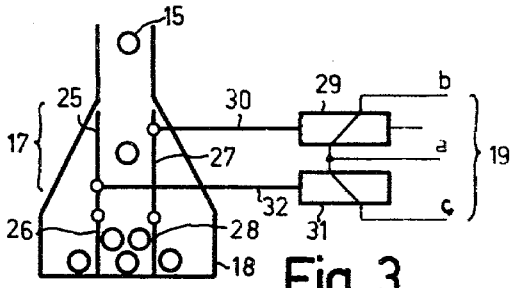
FIGS. 3, 4 and 5 illustrate a sorting device for three product classes in each of one of the three possible positions.
Figure 4:
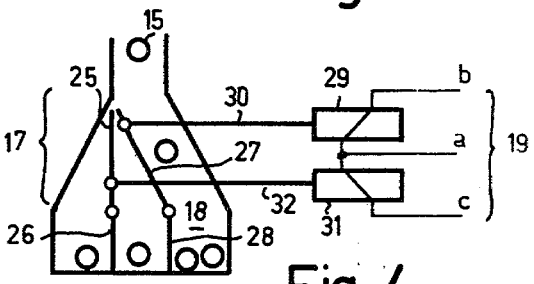
Figure 5:
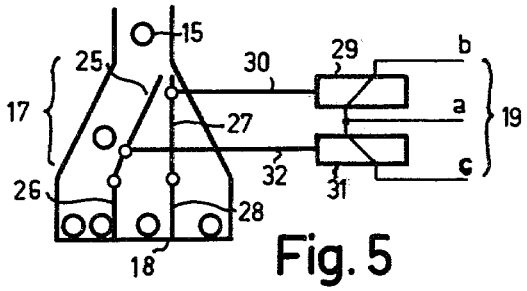

FIGS. 3 to 5 show a container 18 with two partition walls 26, 28 which are connected to respective sorting levers 25,27. Each of the sorting levers may be activated by a respective push rod 30,32 by an electromagnet 29,31. The electromagnets are connected to the evaluation device 8 by the control cable 19 and wires a, b and c. Both the sorting levers 25,27 are shown in FIG. 3 in a vertical position such that the spinning bobbins 15 fall into the center chamber. As shown in FIG. 4, sorting lever 27 has been swung to the left as a result of a current pulse travelling through wires a,b; therefore, the spinning bobbins 15 fall into the right-hand chamber. However, as shown in FIG. 5, sorting lever 25 is deflected to the right due to a current pulse supplied through the pair of wires a, c and the spinning bodies 15 fall into the left-hand chamber of the container. In the embodiment illustrated, the wires a, b, and c connected to the control cable 19 leading to the evaluation device 8 are so arranged that the center chamber corresponds to perfect quality, the left-hand chamber corresponds to a poorer quality, and the right-hand chamber corresponds to an intolerable number of thread breaks in each spinning bobbin 15. However, other designations or uses for the chambers can be made within the teachings of this invention.

The method of the invention also permits more than three classes to be produced; it is just a question of economy whether a more comprehensive subdivision is advantageous. There is no difficulty in terms of the apparatus in increasing the number of classes to any number.

Other systems for directing the falling spinning bodies into different containers are obviously also possible. However, they are completely based on the same principle that the stored thread break data may be used for selecting the relevant classes.

Figure 6:
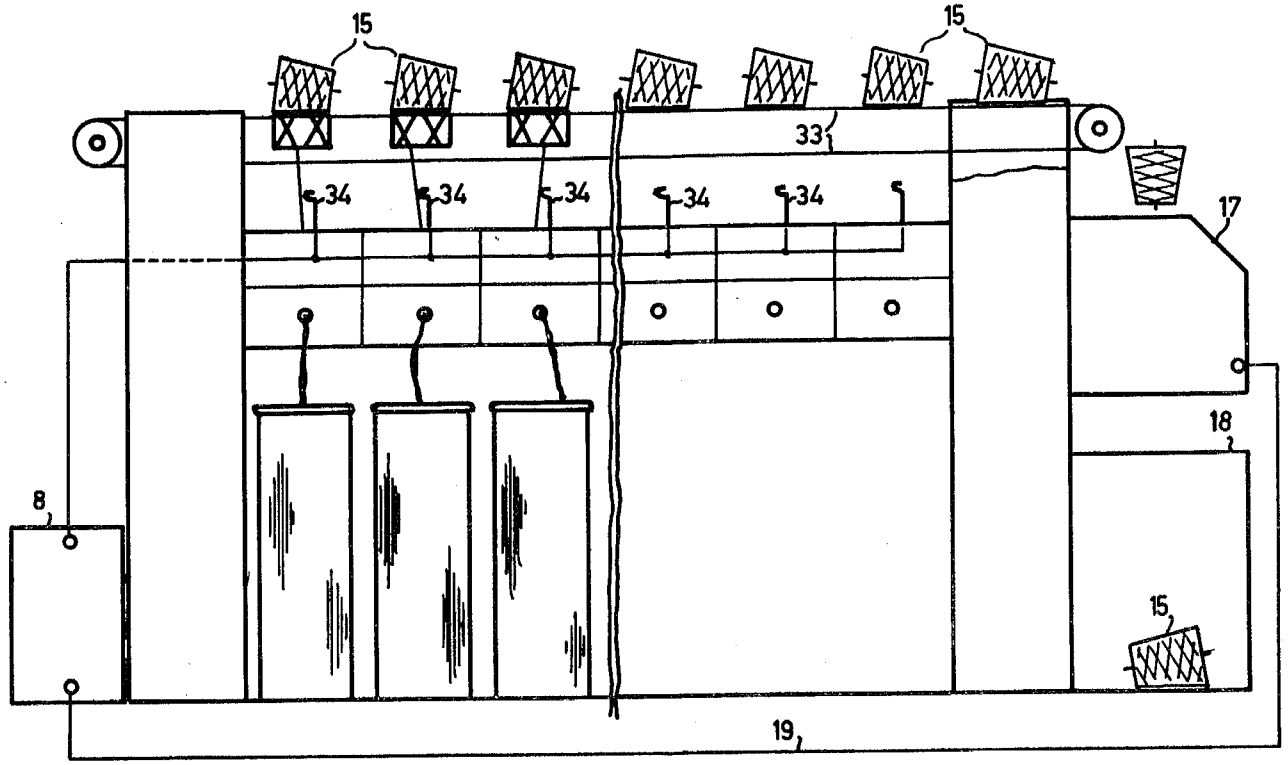
FIG. 6 illustrates the application of the invention to an open end spinning machine.

Finally, FIG. 6 illustrates the application of the present invention to an open end spinning machine. In contrast to the embodiment of FIG. 1, the following differences exist which, however, do not impair the essence of the method of this invention. First of all, a conveyor installation 33 for the spinning bobbins 15 is located above the spinning machine, since the direction of the spinning process runs upwards from below and the spinning bobbins 15 are built upon top of the machine; and a thread sensor 34 is provided for each spinning station so that all spinning stations are constantly monitored by the evaluation device 8.

Thus, the standstill times are very precisely recorded. Each thread sensor 34 is connected to the evaluation device 8. However, it is also possible to combine the output lines of several thread sensors in a multiplexer and to still only store and evaluate the signals of the multiplexer in the evaluation device 8.

It is assumed that other details concerning the open end spinning machine are known, so that the machine is not described in more detail. The sorting lever 17 and the container 18 may be constructed identically to those described with reference to FIGS. 2 through 5.

While I have shown and described several embodiments in accordance with the present invention, it is understood that the invention is not limited to the details shown and described herein but is intended to cover all changes and modifications as known to those of ordinary skill in the art, and I therefore do not wish to be limited to the details shown and described herein but intend to cover all such changes and modifications obvious to one of skill in the art.

What is claimed is:

1. A method of sorting spinning bodies on spinning machines having plural spinning stations comprising the steps of detecting a qualitative feature of each of the spinning bodies at said spinning stations in the spinning machine during spinning; simultaneously removing all of said spinning bodies at said spinning stations; transporting said bodies to an ejection point in the machine; sorting said bodies downstream of said ejection point in accordance with the detected qualitative feature into at least two categories; and dispensing said sorted bodies into respective containers.

2. A method according to claim 1, wherein said bodies are transported to said ejection point in serial fashion in a predetermined order correlated to said spinning stations.

3. A method according to claim 1, wherein said detecting step includes the storing of values of said qualitative feature and said sorting is carried out on the basis of said stored values as compared to selected limit values.

4. A method according to claim 3, wherein said qualitative feature comprises the number of thread breaks of each spinning body.

5. A method according to claim 3, wherein said qualitative feature comprises the duration of the standstill time for each spinning body as a criterion for the length of the spinning product.

6. A method according to claim 1, wherein said sorting step comprises at least three categories.

7. An apparatus for sorting spinning bodies on spinning machines having plural spinning stations, comprising evaluation means for determining values relating to a qualitative feature of the spinning body at each spinning station including means for storing said values in correspondence to the position of the spinning bodies in the spinning machine; transport means for transporting said bodies in series to an ejection point; and sorting means responsive to said stored values for sorting said bodies downstream of said ejection point into at least two categories on the basis of said stored qualitative feature.

8. An apparatus according to claim 7, wherein said qualitative feature comprises the number of thread breaks in each spinning body, and wherein said sorting means includes means for depositing said bodies into separate containers for the respective categories based on different numbers of thread breaks.

9. An apparatus according to claim 7, wherein said qualitative feature comprises the duration of the standstill time for each spinning body as a criterion for the length of the spinning product, and wherein said sorting means includes means for depositing said bodies into separate containers for the respective categories based on different values of standstill time.

10. An apparatus according to claim 7, wherein said sorting means includes means for deflecting certain bodies passing from said ejection point on the basis of said stored values so as to deposit said bodies in separate containers.

11. An apparatus according to claim 7, further including a container having at least one partition which divides the inside space of said container into at least two compartments, means defining a dispensing passage through which bodies pass from said ejection point to said container, and said sorting means including a member pivotally connected to said partition so as to be movable across said passage to divert bodies into the one or the other of said compartments and means responsive to said evaluation means for positioning said member with respect to said passage.

12. An apparatus according to claim 11, wherein said container has a pair of partitions dividing the container into three compartments, said sorting means including a pair of pivotable members mounted on said partitions for diverting bodies passing through said passage into one of said compartments in response to the values stored in said evaluation means.

13. In a spinning machine having a plurality of spinning stations, thread sensing means for detecting thread breaks and standstill time at said spinning stations, evaluation means for evaluating and storing respective values relating to the thread breaks and standstill times detected by said thread sensing means at each spinning station, transport means for receiving ready spun spinning bodies from said spinning stations and for conveying them to an ejection point in a predetermined sequence, and sorting means for sorting said bodies into different categories at said ejection point according to their thread break number and thread break standstill time on the basis of the values stored in said evaluation means.

14. The combination defined in claim 13, wherein said sorting means includes means responsive to said evaluation means for directing the bodies at said ejection point along different paths depending on which category they belong to.

* * * * *